United States Patent [19]

Moore

[11] Patent Number: 4,550,903

[45] Date of Patent: Nov. 5, 1985

[54] SHEET FEEDING APPARATUS AND VALVE THEREFOR

[75] Inventor: Kenneth P. Moore, Rochester, N.Y.

[73] Assignee: Xerox Corporation, Stamford, Conn.

[21] Appl. No.: 513,484

[22] Filed: Jul. 13, 1983

[51] Int. Cl.[4] ..... B65H 3/14

[52] U.S. Cl. ..... 271/98; 271/108

[58] Field of Search ..... 271/94, 97, 98, 108

[56] References Cited

U.S. PATENT DOCUMENTS

| | | | |
|---|---|---|---|
| 3,761,077 | 9/1973 | Vollrath | 271/108 |
| 4,184,672 | 1/1980 | Watkins | 271/108 X |
| 4,236,710 | 12/1980 | Nakamura | 271/108 |
| 4,299,381 | 11/1981 | Smith | 271/96 |
| 4,336,928 | 6/1982 | Smith et al. | 271/3.1 |
| 4,362,380 | 12/1982 | Dragstedt | 271/108 X |

*Primary Examiner*—Richard A. Schacher

*Attorney, Agent, or Firm*—Bernard A. Chiama

[57] ABSTRACT

A document handler employing a vacuum belt feeder having an air knife to aid in sheet separation. The quantity of air discharged from the air knife is varied in accordance with the number of documents placed in the document handler as determined by counting the documents fed through the document handler during the initial feed cycle and actuating a valve having four flow settings: Off, Low, Medium, and High.

4 Claims, 8 Drawing Figures

SHEET FEEDING APPARATUS AND VALVE THEREFOR

With the advent of high speed xerographic copy reproduction machines wherein copies can be produced at a rate in excess of three thousand copies per hour, the need for a document handler to feed documents to the copy platen of the machine or for a copy sheet bottom feeder in a rapid, dependable matter has long been recognized to enable full utilization of the reproduction machines potential copy output. A number of document handlers are currently available to fill that need. These document handlers and copy sheet feeders must operate flawlessly to minimize the risk of misfeeds and multifeeds while still maintaining high speed handling. It is in the initial separation of the individual documents from the document stack or copy sheets from the supply stack where the greatest number of problems occur.

To provide a gentle yet positive feed, conventional copying machines employ a vacuum feed belt assembly beneath the stack of documents or copy sheets to be fed for acquiring the bottom document or copy sheet in the stack to the belts by vacuum and driving the belts to move the acquired document or copy sheet from under the stack into the path of movement for the document or copy sheet. To prevent misfeeds and multifeeds, an air knife is positioned near the lead edge of the stack for injecting air between the acquired sheet and the stack to provide an air bearing between the document or copy sheet being fed and the remainder of the stack. This greatly reduces the force necessary to pull the bottom document or copy sheet from the stack and also minimizes the possibility of the adjacent document or copy sheet being pulled out from under the stack with the document or copy sheet being fed.

While feed mechanisms have been designed that are self-compensating for various paper thicknesses or stiffness, where the document handler will be used with a large variation in the size of the document stack placed therein, a problem may be encountered in providing the correct air flow from the air knife. With a very small stack of documents, excessive air flow could cause excessive document flutter or in the extreme actually blow documents out of the document tray. With a large stack of documents, insufficient air would not produce the required air bearing or separation between the sheets, resulting in the possibility of misfeeds or multifeeds.

It is therefore an object of this invention to vary the air flow from the air knife in a document or sheet feeder in relation to the size of the stack of sheets placed in a support tray of the feeder more accurately and repeatably.

Conventional bottom vacuum sheet feeders utilize a valve in conjunction with an air knife in order to reduce air knife flow during restacking and acquisition of document sheets or copy sheets. The pressure is controlled so that the paper stack, whatever size it may be, will not be under or over levitated, i.e. lubricated, for feeding. The more recent valves are multiple position type (3 or 4) in order to more closely match the air knife pressure to the weight of the stack being fed. The means for accomplishing the multiple positioning of the valve has been to rotate a single flapper plate (controlled valve element) to various positions by way of the use of two solenoids and the appropriate linkage.

In the prior art, such as U.S. Pat. No. 4,299,381, a valve assembly is disclosed for controlling air pressure to an air knife for a document handling apparatus wherein the valve assembly utilizes a bleeder valve to control pressure to an air knife, bleeder valve being automatically adjusted in accordance with the pressure with a vacuum feeder plenum, which may vary depending upon whether a sheet being fed is tightly drawn up against a vacuum feed device.

In U.S. Pat. No. 4,336,928, a valve assembly is disclosed which controls the amount of pressure to an air knife in accordance with the number of documents placed in a document handler as determined by counting document sheets fed into a tray. The valve assembly includes a flapper valve element operable relative to a valve seat and the machine logic, by counting document sheets will activate the valve to either a closed or open position.

The present invention contemplates a sheet feeder for separating and feeding the bottom sheet in a sheet stack, including a plurality of vacuum feed belts spaced at the surface of the sheet stack tray, and positive air pressure means being provided for air floatation of the stack to reduce the effective friction of the stack on the bottom sheet thereof. A dual impeller blower is utilized to provide the sub-atmospheric pressure for the vacuum feed means and the air supply for air floatation. The blower is preferably of the type having independent, isolated impellers and chambers which provide negative pressure (vacuum) and positive pressure without affecting each other. To provide optimum air flow in the system, a nested pair of flapper plates used as valve elements are arranged to be actuated into air flow restriction by respective solenoids.

Figure 1:
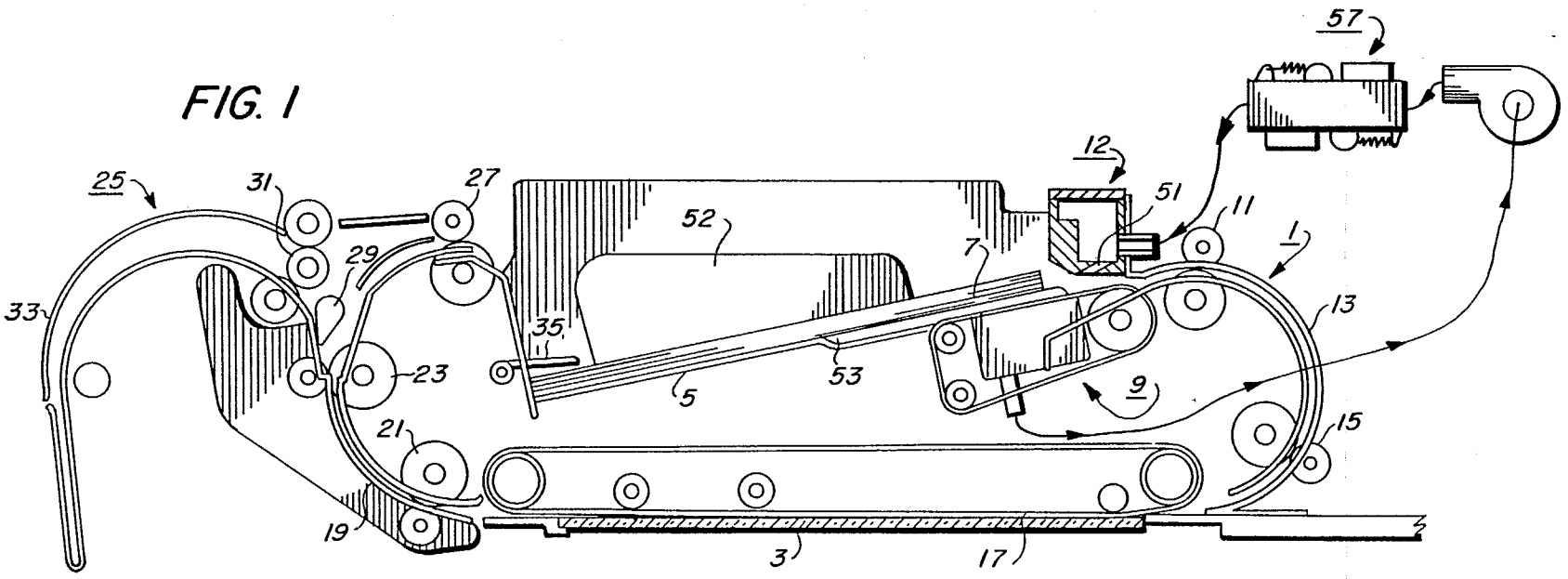
FIG. 1 is a cross-sectional view of an exemplary document handler employing the sheet feeder of the present invention.

While the application of the present invention may find use in either a document handling apparatus or a copy sheet feeder, such as a duplex tray, for purposes of simplicity the invention will be described only with application in a document handler. It will be understood that only the appended claims are to be considered as the scope of the invention in this regard.

Referring to the drawings, there is illustrated an automatic document hander 1 for installation above the exposure platen 3 of a xerographic reproduction machine. The document handler is provided with a document tray 5 to be explained more fully hereinafter, adapted for supporting a stack of documents 7 face up. A vacuum belt-corrugating feeder mechanism 9 is located below the document tray for acquiring and corrugating the bottom document in the stack and forwarding the document to take away roll pair 11 after an air knife 12 has had time to separate sheet 1 from the rest of the stack. The document is then fed by take away roll pair 11 through document guide 13 to feed roll pair 15 and under platen belt 17 onto the platen of the copy machine for reproduction. After exposure of the document, it is fed off the platen by belt 17 into guide 19 and feed roll pairs 21 and 23 either to an inverter mechanism 25 or back to the document stack through the feed roll pair 27.

A diverter 29 is provided to divert the document either to the inverter or to the feed roll pair 27. The inverter comprises a three roll arrangement 31 and a closed inverter pocket 33. If the document is to be inverted it is fed through the lower two rolls of the three roll inverter into the pocket. When the trail edge of the document clears the nip of the lower two rolls in the three roll inverter, the stiffness of the sheet will cause the trail edge to straighten up into the nip of the upper two rolls of the inverter at which time it will be fed into roll pair 27 and back into the document stack.

The inverter pocket illustrated is sized such that when the leading edge of the document contacts the end of the pocket, the document will buckle slightly within the upper portion of the pocket 33, the buckle thereby providing the required force to feed the trailing edge of the document into the upper roll pair of the inverter rolls for feeding the sheet toward roll pair 27. If desired, an open ended inverter pocket could be utilized having a feed roll pair associated therewith for feeding the document back into the upper roll pair in a positive manner rather than relying on the sheet buckle to feed the document thereto.

The document handler is also provided with a sheet separator finger 35 as is well known in the art to separate the documents to be fed from those documents returned to the document handler. Upon removal of the last document from beneath sheet separator finger 35, the finger 35 drops through a slot provided in the tray, suitable sensors (not shown) are provided to sense that the last document in the set has been removed from the tray and the finger is then rotated in a clockwise direction to again come to rest on the top of the documents in the stack prior to subsequent recirculation of the document set.

Figure 2:
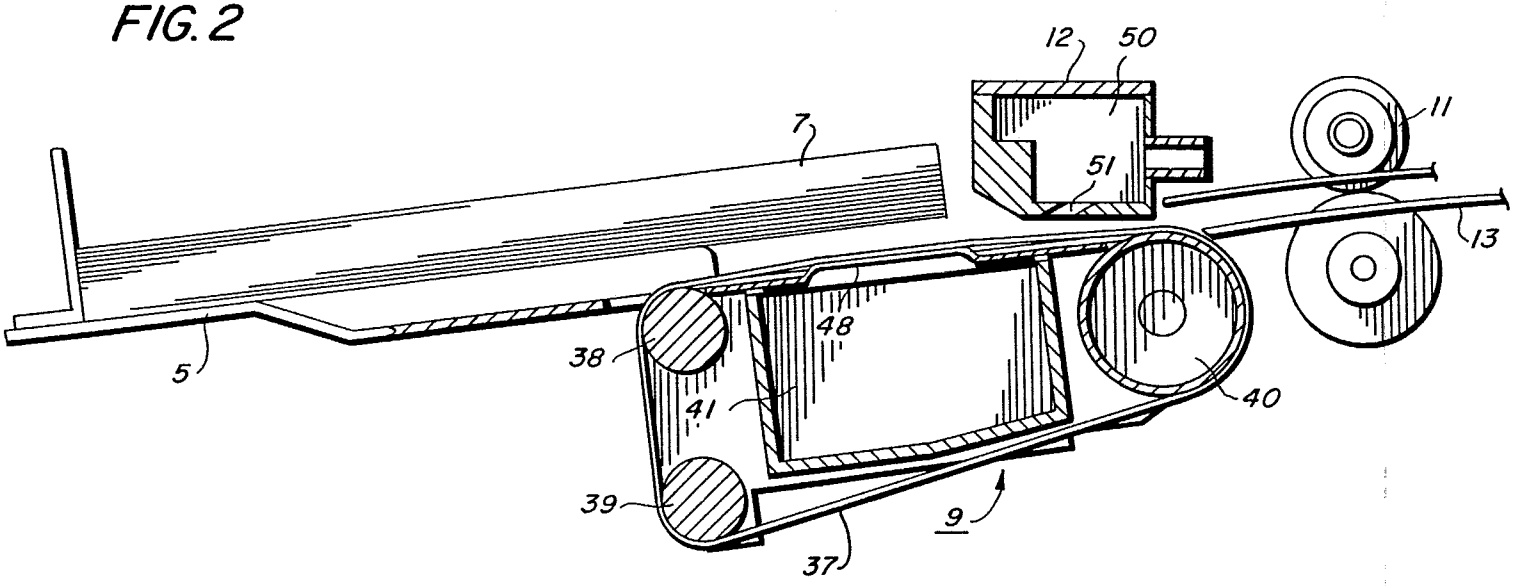
FIG. 2 is an enlarged, cross-sectional view of the separator/feeder portion of the document handler of FIG. 1.
Figure 3:
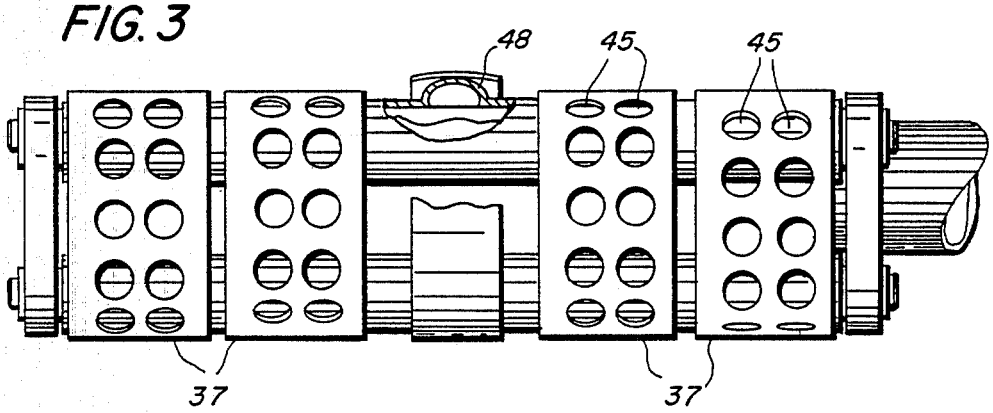
FIG. 3 is a front view of the document tray and feed belts of the document handler illustrated in FIG. 1.
Figure 4:
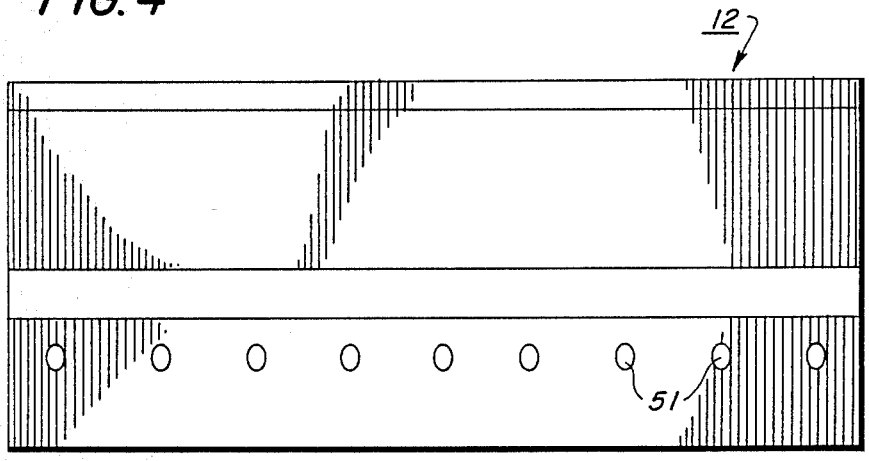
FIG. 4 is a bottom view of the air knife utilized in the present invention; and FIGS. *5a–5d* are sectional views of the positive pressure valve illustrated schematically in FIG. 1 showing different operating conditions of air flow control.

Referring more particularly to FIGS. 2 and 3, wherein the document separator/feeder is more clearly illustrated, there is disclosed a plurality of feed belts 37 supported for movement on feed belt rolls 38, 39, and 40. Spaced within the run of the belts 37, there is provided a vacuum plenum 41 having openings 43 therein adapted for cooperation with perforations 45 in the belts 37 to provide a vacuum for pulling the bottom document in the document stack onto the belts 37. As can be seen from FIG. 2, the belts are below the surrounding support surfaces. Thus, the document is corrugated thereby. In the unlikely event that more than one document is pulled down into contact with the feed belts, the beam strength of the second document resists the corrugating action, thus gaps are opened between sheets one and two which extend to their lead edges. These gaps and channels reduce the vacuum levels between sheets one and two due to porosity in sheet one and provide for entry of the separating air flow from the air knife 12.

The air knife 12 comprised of pressurized air plenum 50 having a plurality of air jet openings 51 is provided to inject air into the pocket formed between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack.

By reference to FIGS. 1, 2, and 3, it can be seen that the document tray 5 is provided with a depressed portion or pocket 53 behind the feed belt assembly. This pocket serves a number of purposes. First, space is provided for the forward portion of the bottom document to be pulled down onto the feed belt assembly. When the bottom document is pulled into this space and corrugated, an envelope type opening or pocket is created between the bottom sheet and the remainder of the sheets in the stack. Air injected into this space from the air knife produces an air bearing between the bottom sheet and the remainder of the stack to allow easy removal of the bottom sheet from beneath the stack. Flow of air from the pocket is restricted by the partial seal or flow restriction caused by supporting the major portion of the stack weight on the edge portions of the tray surrounding the pocket.

By reference to FIG. 1, it can be seen that a blower unit 55 is utilized to provide sub-atmospheric pressure in plenum 41 and pressurized air to air knife 12. A valve 57 is provided in the outlet line to blower 55. With the disclosed system, the blower is operated at continuous speed and air flow through the system is controlled by various flow conditions imposed by the valve 57. At the start of the feed cycle, the valve is fully closed during acquisition. Upon opening of the valve, the flow of air from the air knife is greater than the steady state air flow, i.e. the pressure and initial air flow "spikes". The flow of air provides the required lifting force to float the sheet stack, which settles onto the tray between feed cycles.

Following the feed cycle the air valve 57 is closed. This shuts off air flow to the air knife, allowing the sheet stack to settle back down on the tray and allowing documents to be returned to the tray for restacking without encountering opposing air flow from the air knife.

In order to compensate for variations in the number of documents placed in the document tray and thus assure adequate air flow from the air knife to lift large stacks of documents while at the same time, provide a reduced air flow for different amounts of documents in the tray to prevent sheet blow away, the valve 57 is devised to provide four levels of flow control.

By reference to FIGS. 1, 2 and **5*a*–5*d*, it can be seen that a single blower unit 55 is utilized to provide sub-atmospheric pressure in plenum 41 and pressurized air to air knife 12. Control of the air flow through the system is provided by the control valve 57, best illustrated in FIGS. 5*a* to 5*d*** to assure circumstances to be described below.

As shown in FIGS. **5*a*–5*d*, the valve 57 comprises a valve housing 60 which is connected in the duct between the blower 55 and the air knife plenum 12 with the direction of flow indicated by the arrows 61. Preferably the housing 60 is square in cross section, but any other suitable configuration may be used. Within the housing, a first valve element in the form of a flapper 62 is pivotedly mounted in the fashion of a house door hinge by being formed with a cylindrical edge portion 63 through which a pivot pin 64 extends to permit limiting pivoting action. The portion extends along the upper wall of the housing 60 and is recessed into this wall sufficiently to allow the flapper to become fully recessed in a deformation 65 form in the wall when pivoted to its uppermost inoperative position as shown in FIG. 5***b*.

Similarly, a second valve element or flapper 66 is formed with a cylindrical edge portion 67 along one edge and arranged to surround a pivot pin 68 for pivotal movement therearound. The flapper 66 is adapted to be recessed into a deformation 69 formed in the lower wall of the valve housing when the flapper is pivoted to its lowermost position as shown in FIG. 5*c*.

The flapper valve element 62 is formed with an opening 70 having a predetermined size designed for a particular flow requirement to the air knife plenum 12. In like manner, but at a reduced size, the flapper valve element 66 is formed with an opening 71 also of a predetermined size for flow requirements. The openings 70,71 are positioned on their respective flappers so that when the latter are in their operative position, as shown in FIG. 5*a*, the openings are completely out of alignment and flow through the housing 60 is effectively closed or inhibited.

Figure 5A:
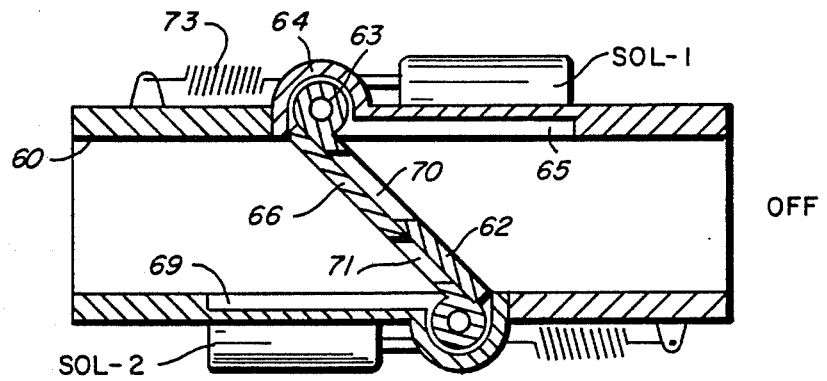
Figure 5B:
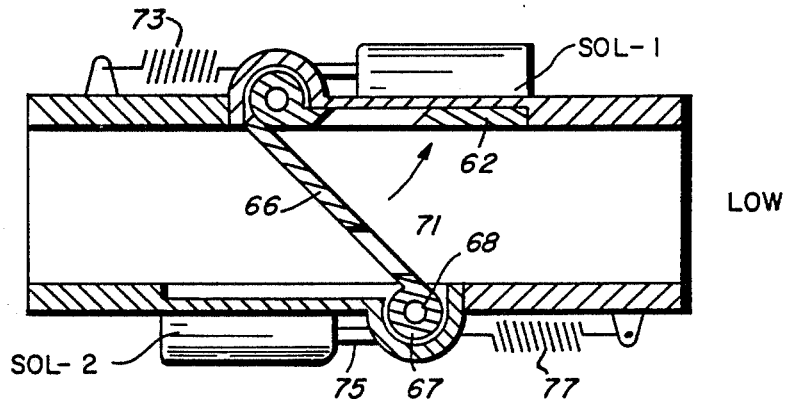
Figure 5C:
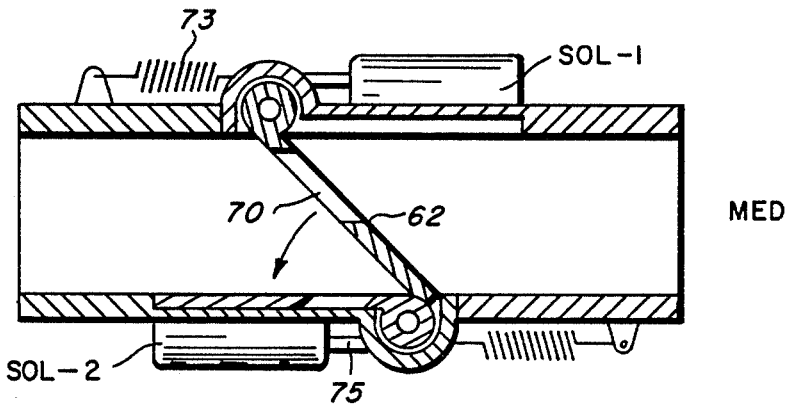

In order to actuate the flapper 62 to either of its two positions, one shown in FIG. 5*a* as the inoperative or flow restriction position and the other, as shown in FIG. 5*b* or its operative position wherein the flapper permits unrestricted flow, there is provided a solenoid SOL-1 mounted on the housing 60 having its reciprocably moving plunger 72 connected to a cable wrapped around the hinge portion 63. When energized, the solenoid SOL-1 pulls its plunger inwardly to effect rotation of the flapper 62 from its position in FIG. 5*a* to that shown in FIG. 5*b*. A coil spring 73 having one end connected to the valve housing 60 and its other end to a cable wrapped around the portion 63 serves normally to rotate and maintain the flapper 62 to and in its inoperative, or normally OFF position, as shown in FIG. 5*a*.

A second solenoid SOL-2 mounted exteriorly of the housing 60 on its lower wall has its plunger 75 connected to a cable wrapped around the hinge portion 67 of the flapper valve element 66. When energized, the solenoid SOL-2 pulls its plunger inwardly to effect rotation of the flapper 66 from its inoperative position as shown in FIG. 5*a*, to its operative position as shown in FIG. 5*c*. A coil spring 77 having one end connected to the valve housing and its other end to a cable wrapped around the hinge portion 67 normally to rotate and maintain the flapper 66 to and in its inoperative or normally OFF position, as shown in FIG. 5*a*.

Figure 5D:
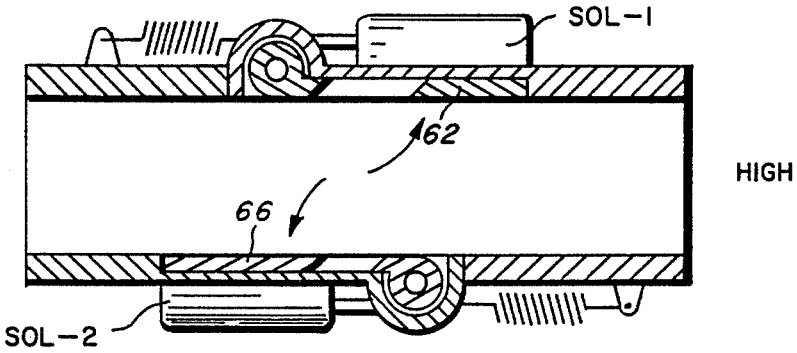

In operation, FIG. 5*d* illustrates the positions of the valve flappers 62, 66 when their respective solenoids having been energized and flow through the housing 60 is fully opened (high flow). In FIG. 5*a*, the flapper 62 is in its inoperative position upon deenergization of its associated solenoid SOL-1, and the flapper 66 is in its inoperative position to restrict flow through the housing to an amount set by the size of the opening 71 (low flow).

In FIG. 5*c*, the flapper 66 is in its operative position by virtue of its associated solenoid SOL-2 being energized. The flapper 62 is in its inoperative position by virtue of the spring 73 restricts the flow through the valve housing to the size of the opening 70 (medium flow). In FIG. 5*a*, both solenoids have been deenergized thus allowing the springs 73 and 77 to rotate their respective flapper valves 62 and 66 to their inoperative positions. In this arrangement, flow through the valve is minimum (off position).

From the foregoing, it will be appreciated that the valve 57 is adapted for four different flow characteristics, depending upon the energization of the solenoids SOL-1 and SOL-2, as programmed in the machine logic in accordance with the demands of the different events in the controlled sheet feeders.

Through control logic, the valve 57 may be actuated to fully open or closed positions and to two other positions of varying flow impedance in accordance with the number of documents placed in the stack. In the disclosed embodiment, this is accomplished by placing the documents to be copied in the document tray, programming the copy machine associated with the document handler for the desired number of copies to be produced and pressing the start button which is the normal sequence of operation for the majority of copiers now on the market. Upon initial energization of the machine, the set separator 35 will be rotated from its position beneath the documents in the stack to a position above the document in the stack. Once the separator 35 is in the proper start position, the various machine elements will be energized such as the blower 55, the feed rolls, document belts, etc.

If simplex copies are to be produced, the control logic will cause feeding of documents from the tray and production of copies therefrom. A suitable sensor combined with the set separator 35 may be utilized to determine the number of document sheets in the tray 5 by measuring stack height. Electrical signals generated in response to stack height are fed to the machine logic for controlling energization of the solenoids SOL-1, SOL-2 in accordance with the foregoing description of the valve 57.

Since the disclosed document handler is adapted to invert documents to allow simplex to duplex or duplex to duplex copying if the copy machine with which it is utilized has the proper capabilities, when the machine is programmed for producing duplex copies from simplex documents or duplex copies from duplex documents, the first circulation of documents would be a document "slew" to enable counting or inverting of the documents to enable the machine logic to set up the proper copy sequence. Under these conditions, the documents being circulated in the "slew" mode will be counted by a suitable counter 71.

Thus, whenever stack of documents is placed in the document handler and the machine is programmed for the desired copy sequence, the stack height is determined by way of the set separator and associated sensor, which is utilized to energize the solenoids as the case may be to tailor the output of the air knife to the document stack size. As stated heretofore, this will prevent document blow away of small document stacks which could occur in the event that a constant output air knife were utilized and yet provide sufficient air for large document stacks when necessary.

While the invention has been described with reference to the structure disclosed, it is not confined to the details set forth, but is intended to cover such modifications or changes as may come within the scope of the following claims.

I claim:

1. A bottom sheet separator/feeder for separating and forwarding sheets seriatim having a stack tray adapted for supporting a stack of sheets and means for determining the stack size being fed, comprising:

air injection means adapted to provide a layer of air between the tray and the bottom sheet in the stack in between the bottom sheet and the remainder of the sheets in the stack, blower means associated with said air injection means to provide positive air pressure for said air injection means, valve means associated with said air injection means being adapted to control the flow of air thereto from said blower means and having a plurality of adjusting devices each being arranged to provide a different air flow to said injection means in accordance with different stack sizes.

2. The separator/feeder of claim 1 wherein said adjusting devices comprise movable elements each of which being arranged to be actuated into the air flow through said valve means to limit the flow therethrough and being formed with different predetermined sizes of openings whereby said elements establish predetermined air pressures for said air injection means different from each other.

3. The separator/feeder of claim 1 wherein said adjusting devices comprise movable elements each having a different flow restrictive shape relative to air flow through said valve means when said element is moved into the air flow, said valve means including control means for selectively actuating said elements into the air flow.

4. The separator/feeder of claim 3 wherein said control means being operatively connected to said elements and said shapes are such that upon actuation of said elements: (1) into the air flow prevents the air to said air injection means, (2) out of the air flow, permits maximum air flow, (3) and any of said elements into the air flow individually permits different intermediate amounts of air flow.

* * * * *